US005309658A

United States Patent [19]

Cohen et al.

[11] Patent Number: 5,309,658

[45] Date of Patent: May 10, 1994

[54] DISPLAY ELEMENT OF TRANSPARENT PLASTIC WITH FLUORESCENT COLORANT

[76] Inventors: Henri Cohen, Lipperkerkstraat 373, NL 7533 AD Enschede; Gertjan R. Willemsen, Polluxstraat 29, NL-7521 JT Enschede; Remco S. Schoppen, Lipperkerkstraat 375, NL-7533 AD Enschede, all of Netherlands

[21] Appl. No.: 859,515

[22] PCT Filed: Oct. 8, 1990

[86] PCT No.: PCT/NL90/00146

§ 371 Date: Jun. 8, 1992

§ 102(e) Date: Jun. 8, 1992

[87] PCT Pub. No.: WO92/06461

PCT Pub. Date: Apr. 16, 1992

[51] Int. Cl.[5] ..... G09F 13/16

[52] U.S. Cl. ..... 40/583; 362/252; 362/346

[58] Field of Search ..... 40/564, 550, 551, 582, 40/583; 359/599; 362/812, 252, 339, 346

[56] References Cited

U.S. PATENT DOCUMENTS

| | | | |
|---|---|---|---|
| 1,348,816 | 8/1920 | Limpert | 362/812 X |
| 1,735,815 | 11/1929 | Treleaven | 362/812 X |
| 2,167,660 | 8/1939 | Lauve, Jr. | 362/812 X |
| 2,168,223 | 8/1939 | Lauve, Jr. . | |
| 2,269,325 | 1/1942 | Veitch . | |
| 2,317,162 | 4/1943 | Wood | 362/812 X |
| 2,365,447 | 12/1944 | Best | 40/583 X |
| 2,798,147 | 7/1957 | Orsatti | 359/528 |
| 3,399,477 | 9/1968 | Johnson, Jr. et al. | 40/583 |

FOREIGN PATENT DOCUMENTS

| | | |
|---|---|---|
| 0395176 | 10/1990 | European Pat. Off. . |
| 892547 | 11/1953 | Fed. Rep. of Germany . |
| 8708573 | 10/1987 | Fed. Rep. of Germany . |
| 1128737 | 7/1955 | France . |
| WO92/06461 | 4/1992 | PCT Int'l Appl. . |

*Primary Examiner*—Brian K. Green

*Attorney, Agent, or Firm*—Webb, Burden, Ziesenheim & Webb

[57] ABSTRACT

An element is disclosed for displaying one or more portions of characters or shapes, wherein the display element comprises partially transparent plastic in which fluorescent colorant is incorporated. Preferably the inside of one head end is provided with a profiled form.

5 Claims, 1 Drawing Sheet

DISPLAY ELEMENT OF TRANSPARENT PLASTIC WITH FLUORESCENT COLORANT

BACKGROUND OF THE INVENTION

The present invention provides a display element for displaying one or more portions of characters or shapes, wherein the display element comprises partially transparent plastic in which fluorescent colorant is incorporated.

SUMMARY OF THE INVENTION

Such a display element shows for instance text in very clear manner if a number of these display elements are arranged in a background, for example a metal grid provided with holes, and if light or (partially) invisible radiation such as so-called "black light" falls onto such a pattern of display elements.

In preference the inside of the head end of a display element takes a profiled form so that a rear side of the display element results that is provided with facets, whereby the front view of the display element exhibits a highlighting illumination.

A most preferred embodiment of such a display element is provided with concentric rings at the head end of the inside thereof; when radiated such a display element is the most clearly noticeable relative to a plurality of different display elements which were injection moulded by way of experiment with differing profiling on the inside of the head end.

BRIEF DESCRIPTION OF THE DRAWINGS

Further advantages, features and details will be elucidated in the following description of preferred embodiments of the present invention with reference to a drawing, wherein.

DESCRIPTION OF THE PREFERRED EMBODIMENTS

Figure 1:
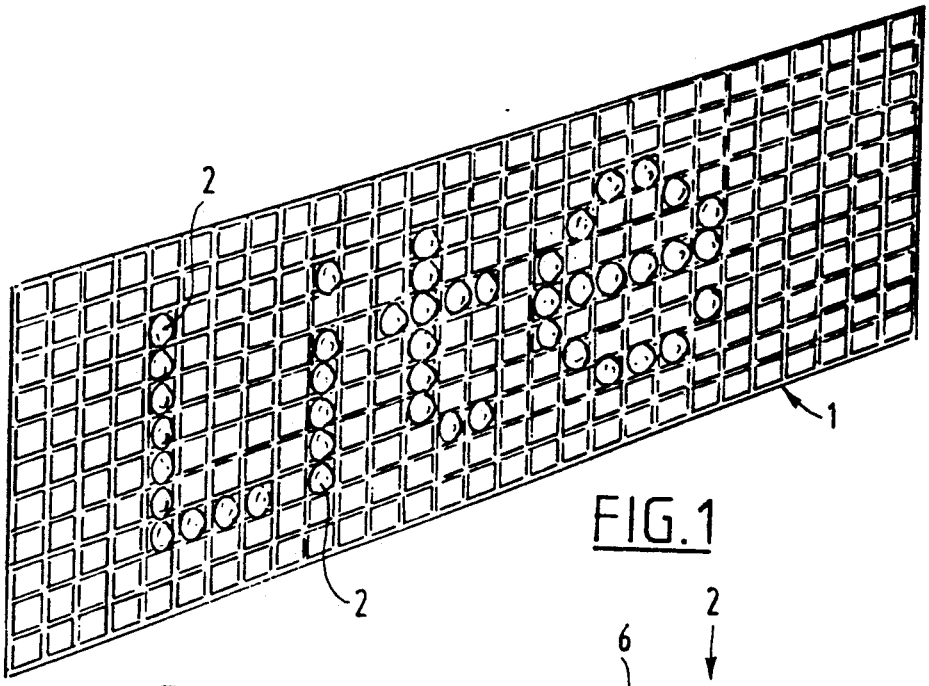
FIG. 1 shows a perspective view of a background provided with a first embodiment of the present invention.

If in a background 1 (FIG. 1), for instance a metal grid, display elements 2 are arranged in a particular pattern, texts or shapes can be shown as desired herewith in the grid 1. The display elements 2 are manufactured from transparent plastic with fluorescent colorants such as for instance those made commercially available by the Bayer company under the name Lisa. A particular illuminating effect results when such display elements 2 are radiated with light (sunlight (also diffuse), artificial light) or ultraviolet radiation such as "black light". The colorants relate preferably but not exclusively to fashion colours such as turquoise, violet and the like. The radiation generated in the display element by fluorescence will exit substantially via the convex head end.

A display element according to the present invention also displays a conspicuous appearance if radiated from the jacket end 1 from behind the grid, for instance by means of a black light.

A display element 2 preferably has roughly the form of an internally hollow toadstool provided with an approximately rounded conical or convex head end that projects over a hollow cylindrical end 4 so that the head end 3 has a large target surface for the radiation. The radiation enters via the head end into the interior of the transparent display element.

Figure 3:
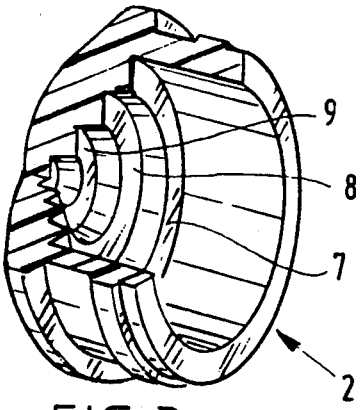
FIG. 3 is a partly broken away, oblique rear view of the display element of FIG. 2.
Figure 2:
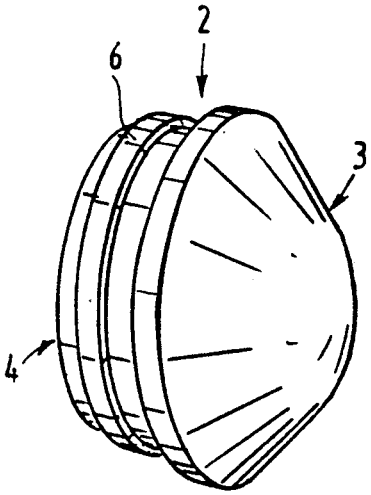
FIG. 2 is an oblique front view of a display element of FIG. 1.

The cylindrical jacket 4 is preferably provided with a snap-in edge 6 for snapping-in that jacket end into the grid 1. The display element 2 (FIG. 3) is in preference provided on the inside of the head end 3 with concentric, annular edges 7, 8 and 9 which are staggered respectively in lengthwise direction of the display element 2 and which form facets for reflection of the radiation entering the head end which, as with a diamond, cause a shining/sparkling, with the result that the display element is very highly visible.

Figure 4:
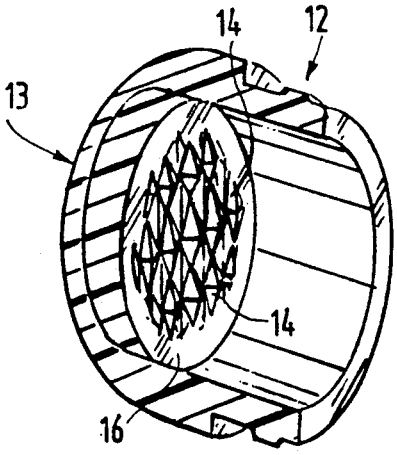
FIG. 4 shows a partly broken away, oblique rear view of a second of the present invention.
Figure 5:
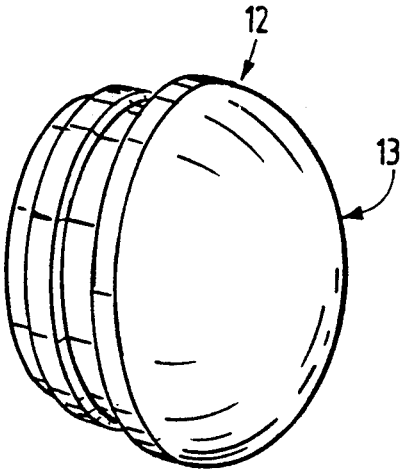
FIG. 5 is a perspective, oblique front view of the embodiment, of FIG. 4.

Another embodiment 12 of the display element according to the present invention (FIG. 4, 5) is provided with a convex head end 13 and a plurality of comparatively small facets 14 Which are arranged in an inner wall 16 which runs parallel to the head end surface 13.

The embodiment shown can be manufactured in elegant manner in large quantities with a device for injection moulding of plastic.

We claim:

1. A one piece display element for displaying one or more portions of characters or shapes, said one piece display element formed of a partially transparent plastic having a fluorescent colorant incorporated therein, said one piece display element comprising a plastic head member integrally attached to a first end of a substantially cylindrical plastic member, said cylindrical plastic member having a second open end spaced from said first end and defining a hollow interior between said first end and said second open end, said plastic head member having a substantially rounded, conical outer surface overlapping said cylindrical plastic member wherein said plastic head member has a diameter greater than an outer diameter of said cylindrical plastic member, said plastic head member having an inner surface with stepped concentric, annular reflection surfaces, and wherein said cylindrical plastic member includes a raised annular snap-in ridge extending from an outer surface of said cylindrical plastic member at a position spaced from said plastic head member, and said second open end of said cylindrical plastic member is positioned opposite from said inner surface of said plastic head member wherein said one piece display element is configured to allow light to enter said second open end and travel through said hollow interior within said cylindrical plastic member and exit said plastic head member.

2. The display element of claim 1 wherein said stepped concentric, annular reflection surfaces are located at mutual intervals in a lengthwise direction of said display element.

3. The display element of claim 1 wherein said display element is formed by injection molding.

4. A display element for displaying one or more portions of character or shapes, said display element formed of a partially transparent plastic having a fluorescent colorant incorporated therein, said display element comprising a head member integrally attached to a substantially cylindrical member defining a hollow interior, said head member having a substantially rounded, convex outer surface overlapping said cylindrical member wherein said head member has a diameter greater than an outer diameter of said cylindrical member, said head member having an inner surface positioned substantially perpendicular to an axis of said cylindrical member, said inner surface including a plurality of comparatively small facets arranged in a variety of angular orientations, and wherein said cylindrical member includes a raised annular snap-in ridge extending from an outer surface of said cylindrical member at a position spaced from said head member.

5. The display element of claim 4 wherein said display element is formed by injection molding.

* * * * *